US006581944B1

(12) United States Patent
Marmonier et al.

(10) Patent No.: US 6,581,944 B1
(45) Date of Patent: Jun. 24, 2003

(54) SNOWBOARD BINDING

(75) Inventors: Gilles Marmonier, Saint Etienne de Crossey (FR); Pascal Joubert Des Ouches, Coublevoie (FR)

(73) Assignee: Skis Rossignol S.A., Voiron (FR)

( * ) Notice: Subject to any disclaimer, the term of this patent is extended or adjusted under 35 U.S.C. 154(b) by 14 days.

(21) Appl. No.: 09/721,089

(22) Filed: Nov. 22, 2000

(30) Foreign Application Priority Data

Nov. 25, 1999 (FR) ..... 99 14821

(51) Int. Cl.[7] ..... A63C 9/22
(52) U.S. Cl. ..... 280/14.22; 280/619; 280/634
(58) Field of Search ..... 280/623, 611, 280/633, 634, 14.22, 14.23, 14.24, 619

(56) References Cited

U.S. PATENT DOCUMENTS 5,261,689 A * 11/1993 Carpenter et al. ..... 280/618
5,356,170 A * 10/1994 Carpenter et al. ..... 280/618
5,609,347 A * 3/1997 Dressel ..... 280/14.22
5,660,410 A * 8/1997 Alden ..... 280/627
5,727,797 A * 3/1998 Bowles ..... 280/14.2
5,855,390 A * 1/1999 Hassell ..... 280/607
5,967,531 A 10/1999 Saillet ..... 280/11.36
5,971,407 A * 10/1999 Zemke et al. ..... 280/14.22
6,027,136 A * 2/2000 Phillips ..... 280/618
6,061,870 A * 5/2000 Dodge et al. ..... 280/618
6,267,403 B1 * 7/2001 Bossin et al. ..... 280/625
6,283,482 B1 * 9/2001 Coulter ..... 280/14.22
6,283,495 B1 * 9/2001 Phillips ..... 280/618
6,364,323 B1 * 4/2002 Coulter ..... 280/14.22
6,394,484 B1 * 5/2002 Maravetz et al. ..... 280/624
2002/0005627 A1 * 1/2002 Plassiard ..... 280/623

FOREIGN PATENT DOCUMENTS

DE U-91 13766.7 4/1992
FR 2751238 1/1998

* cited by examiner

*Primary Examiner*—Brian L. Johnson
*Assistant Examiner*—Jeffrey Restifo
(74) *Attorney, Agent, or Firm*—Heslin Rothenberg Farley & Mesiti P.C.; Victor A. Cardona, Esq.

(57) ABSTRACT

A Snowboard binding includes a baseplate intended to be mounted on a snowboard. A rear bow, is mounted on the baseplate (2) at two attachment points and a highback is mounted so that it can pivot with respect to the rear bow. Further included are means for independently modifying the vertical position of each point of attachment of the bow (3) to the baseplate (2).

12 Claims, 3 Drawing Sheets

SNOWBOARD BINDING

TECHNICAL FIELD

The invention relates to the field of sports that involve sliding on snow, and more particularly to the sport of snowboarding. It relates more specifically to the bindings intended to be mounted on snowboards, the design of which makes them particularly ergonomic.

PRIOR ART

Numerous types of snowboard binding exist, each type being more particularly suited to a particular style of snowboarding.

Thus, as far as "artistic" snowboarding is concerned, this being the style more commonly known by the name "freestyle", use is made of relatively flexible boots allowing the user great freedom of movement and allowing the shinbone to be steeply angled with respect to the foot. Its qualities are particularly appreciated when riding on semi-cylindrical trails most commonly known by the name of "halfpipes".

Thanks to the flexibility of his boots, the rider can adopt particularly inclined positions with respect to the board.

The relative flexibility of the boots also allows a good feel through the board.

The use of such flexible boots entails the use of bindings which have a certain rigidity, particularly in order to resist back thrust.

Thus, such bindings have a baseplate for mounting on the board, and a rear cup forming a highback intended to take the back of the upper of the user's boot. A highback such as this may extend as high as mid-way up the calf.

For reasons of bulk, most bindings of this type have a highback which is mounted so that it is articulated with respect to the baseplate, which allows it to be folded down toward the board for transport.

Document DE-U-91 13766.7 describes a binding such as this. This binding is equipped with two symmetric stops arranged on the highback and intended to limit the backward inclination of the highback. These stops are adjustable for height in order to adapt the rearmost position of the highback to the user's wishes.

It will be appreciated that the vertical position of the highback is not the optimal position for reacting thrust when the leg is slightly inclined with respect to a position perpendicular to the board.

This is a particularly sensitive issue in the so-called "artistic" form of riding in which the rider, in certain phases, adopts a position which is highly offset from the normal position.

One problem that the invention sets out to solve is that of the stiffness of the binding, and its incompatibility with the need to optimize the inclination of the legs with respect to the board.

Among snowboard bindings comprising an articulated highback, some also have a rear bow, mounted on the baseplate and passing behind the foot, at roughly heel level.

In this case, the highback is mounted directly on the bow and can be folded down by pivoting with respect to the bow.

In general, the bow is secured to the baseplate at two points of attachment on the sides of the baseplate.

Use of a bow makes it possible in particular to stiffen the binding.

SUMMARY OF THE INVENTION

The invention relates to snowboard bindings of the aforementioned type, that is to say those comprising:

- a baseplate intended to be mounted on a snowboard;
- a rear bow mounted on the baseplate at two attachment points;
- a highback mounted so that it can pivot with respect to the rear bow A binding such as this is characterized in that it comprises means for independently modifying the vertical position of each point of attachment of the bow to the baseplate.

In other words, by differently modifying the position of the points of attachment of the bow to the baseplate, it is possible to incline the bow in such a way that the highback secured to it undergoes a lateral inclination movement.

Thus the "canting" or lateral inclination of the highback can be adjusted without direct action on the highback itself. The mechanical connection between the highback and the bow remains exclusively of the pivoting type and is completely separate from the function of adjusting the "canting".

Advantageously, in practice, the means allowing such adjustment consist of:

- two horizontally notched zones capable of collaborating, secured to the bow and to the baseplate, and having a number of relative positions;
- anchoring means intended to keep the two notched zones in the position corresponding to the desired vertical position of the bow with respect to the baseplate.

In other words, depending on the relative position of the notched zones located respectively on the bow and on the baseplate, the difference in height of the points of attachment on the bow are adjusted, and therefore the inclination of this bow with respect to the baseplate. The inclination of the bow directly causes lateral orientation of the highback.

The precision of the adjustment of the difference in height and point of attachment, and therefore of the "canting" of the binding is governed by the pitch of the notched zones.

In a particular embodiment, the baseplate has, on each side, a slot separating two walls between which the end of the bow penetrates.

By virtue of this arrangement, the collaborating notched zones belonging to the baseplate and to the bow are protected from any ingress of snow which could jam the mechanism and prevent the position of the bow from being modified.

Advantageously, in practice, one of the walls of the side of the baseplate has a moving part with a notched zone while the other notched zone is on the face of the end of the bow intended to face the moving part.

Advantageously, in practice, the movement of the moving part is subject to the rotation of the locking screw passing through an opening drilled in the end of the bow.

Thus, the moving part is pressed against the complementary notched zone by the locking screw.

Various geometries can be adopted while at the same time remaining within the scope of the invention. Hence, the moving part may be located relative to the bow either on the same side or on the opposite side from the head of the locking screw.

In the same way, the head of the locking screw may be located either on the inside or on the outside of the side of the baseplate. In this latter arrangement, it is easier to access the locking screw for making adjustments.

According to another feature of the invention, the binding further comprises means for adjusting the horizontal position of the points of attachment of the bow to the baseplate.

Thus, it is possible to adapt the position of the bow to suit different boot sizes, by imposing a longitudinal translation on the bow, which translation is possible by virtue of the geometry of the notched zones.

Advantageously, in practice, the opening that the locking screw enters is horizontally elongate.

BRIEF DESCRIPTION OF THE FIGURES

The way in which the invention is achieved, and its ensuing advantages will become clearly apparent from the description of the embodiments which follow, in support of the appended figures, in which.

EMBODIMENTS OF THE INVENTION

Figure 1:
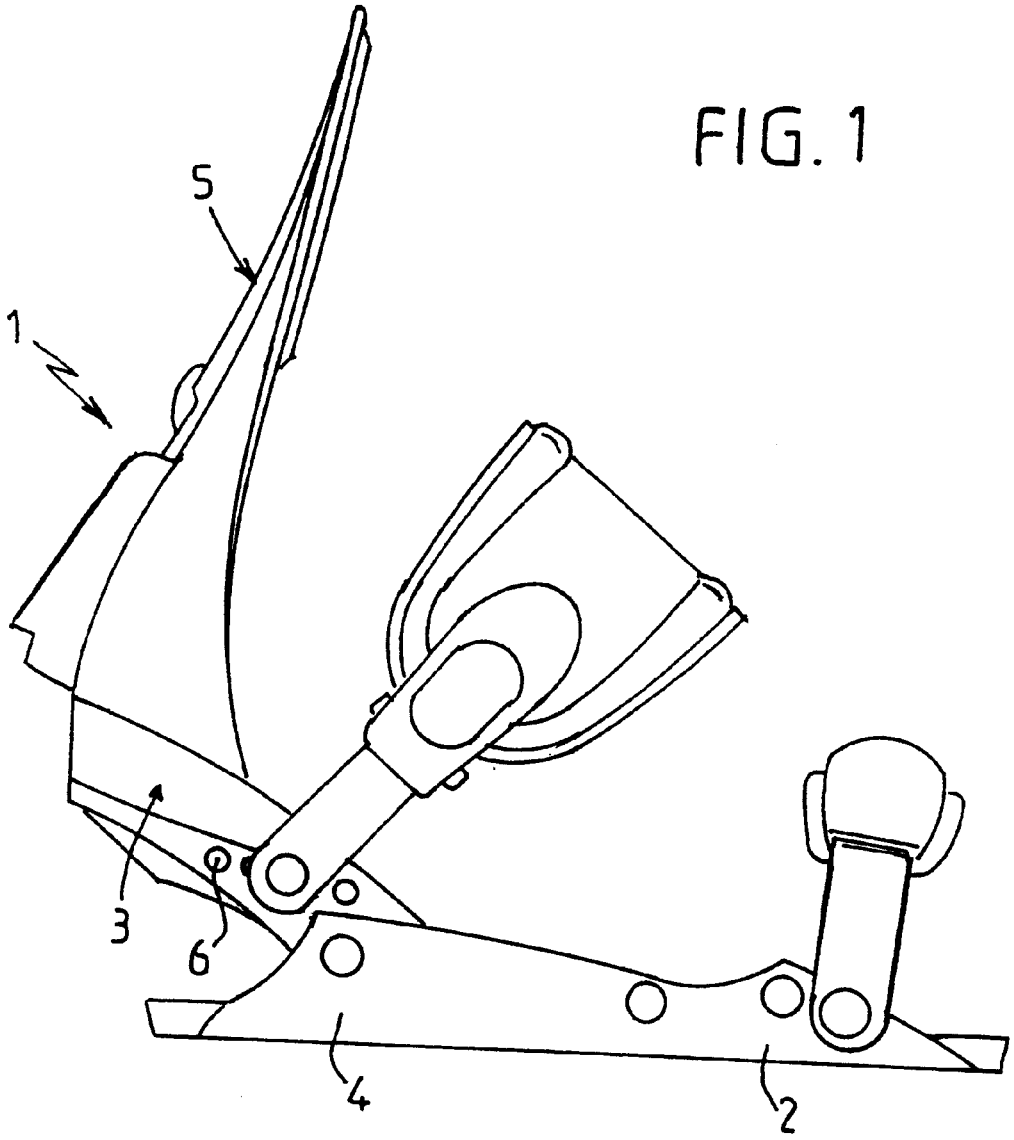
FIG. 1 is a side view of the snowboard binding comprising a rear bow according to the invention.

As already stated, the invention relates to a snowboard binding (1) which essentially comprises a baseplate (2) intended to be mounted on the snowboard, and to the rear of which is attached a rear bow (3) connecting the two sides (4) of the baseplate and passing behind the heel.

This rear bow (3) takes a highback (5) intended to come into contact with the rear part of the boot upper.

In a known way, the highback (5) is mounted so that it can pivot with respect to the bow (3) at two pivot pins (6).

By virtue of this arrangement, it is possible to fold the highback down when the binding is not in use, and thus limit the amount of space it occupies and make it easier to store.

The binding according to the invention also comprises means for retaining the boot, which may vary widely and are of no importance to the principle of the invention.

Thus, FIG. 1 depicts a binding in which the boot is held in place by two transverse straps arranged respectively near the end of the boot, in line with the metatarsophalangeal joint, and at the neck of the foot.

Nevertheless, numerous other forms of retaining means can be used without departing from the scope of the invention.

Thus, according to an important feature of the invention, the binding comprises means for independently modifying the vertical position of each point of attachment of the bow to the baseplate.

By virtue of this feature, it is possible to vary the inclination of the rear bow (3), and therefore of the highback (7) attached directly to it. Inclination such as this, generally known as "canting" is particularly useful for transmitting thrust correctly when the leg is slightly laterally inclined.

Adjustment such as this is done as already stated because of the possibility of independently modifying the vertical position of each point of attachment of the rear bow (3) to the baseplate (2) and more specifically to the sides (4) of such a baseplate.

Figure 2:
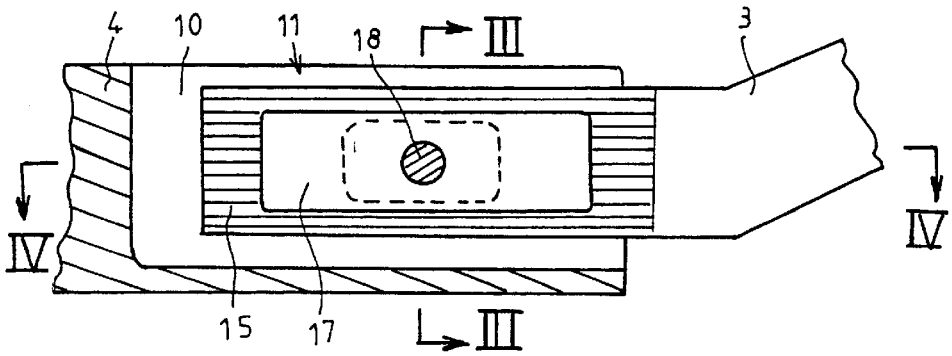
FIG. 2 is a detail side view of the zone of the point of attachment of the bow to the baseplate.

FIG. 2 illustrates one embodiment that makes it possible to achieve such adjustment, which is illustrated by way of illustrative and nonlimiting example.

Thus, each side (4) of the baseplate comprises, at its zone of connection to the bow (3), a longitudinal slot (10) separating the baseplate into two walls (11, 12) between which the end (15) of the bow (3) can slide. More precisely, the end (15) of the bow (3) has a notched face, intended to collaborate with another notched element secured to the baseplate (3) of the binding.

Figure 4:
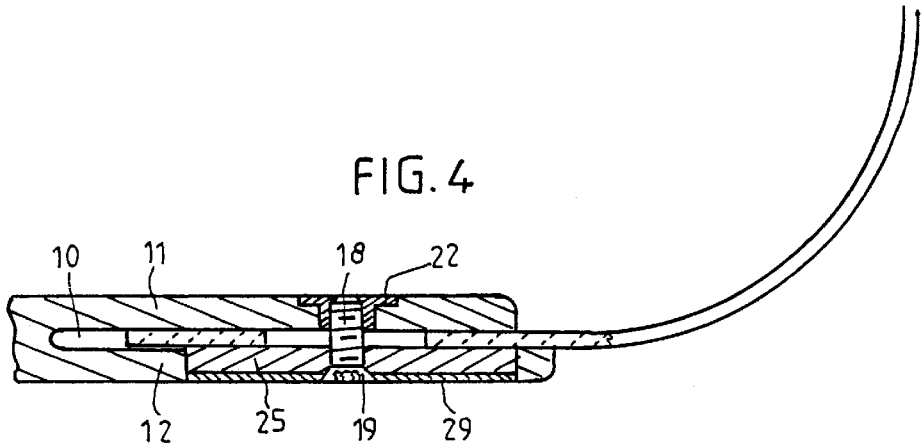
FIG. 4 is a part section on IV–IV' of FIG. 2.
Figure 3:
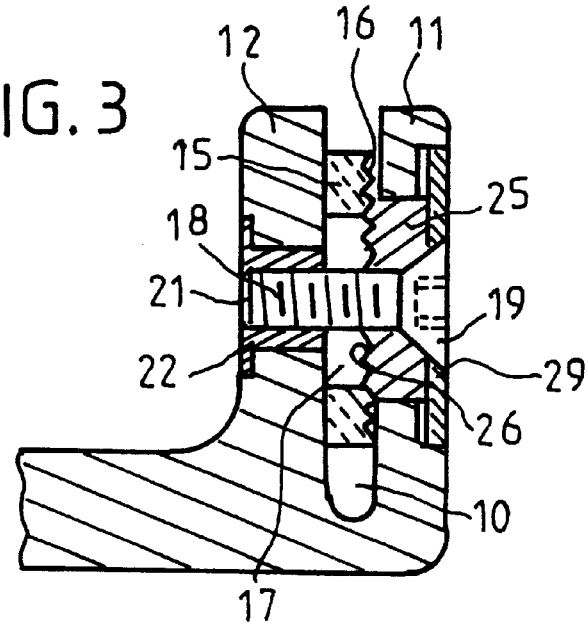
FIG. 3 is a view in section on III–III' of FIG. 2.

More specifically, as illustrated in FIGS. 3 and 4, the end (15) of the bow (3) has its face (16) facing toward the outside of the binding, which is notched. These notches are horizontal and are intended to collaborate with complementary notches formed on a part secured to the baseplate.

The end (15) of the bow (3) has an opening (17) through which there passes a screw (18) the head (19) of which is visible on the outside of the side (4) of the baseplate (3).

The end (21) of this screw (18) enters a screw thread (22) made in the wall (12) of the baseplate opposite the side of the head (19) of the screw (18). This screw thread may, for example, be made in an attached part, made of a different material than the rest of the baseplate.

This screw (18) collaborates with a moving part (25) of which the face (26) facing the bow is also notched. The shape and pitch of these notches are identical to those on the face (16) of the bow. Thus, when the screw (18) is screwed into the part (22), the part (25) is pushed back into the slot, and comes into contact with the face (16) of the bow.

Thus, the end (15) of the bow is pressed against the wall (12) of the side of the baseplate (3) and is thus held in position.

Advantageously, the moving part (25) is hidden by a plate (29) driven by the head (19) of the screw (18).

In the embodiment illustrated, the number of notches and their spacing allows the height of the point of attachment of the bow (3) to the baseplate (2) to be shifted about 4 millimeters above and below the central position. In terms of bow and therefore highback orientation, this results in an inclination of the order of 4 degrees.

Of course, the magnitude of this orientation can be modified by adopting a different geometry, in keeping with the principle of the invention.

Figure 5:
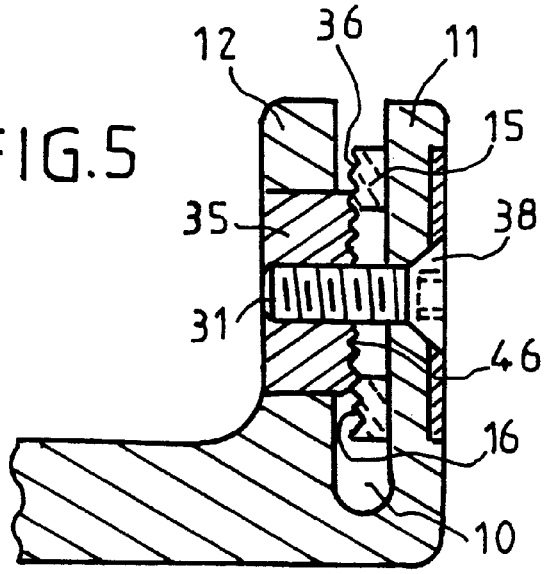
FIG. 5 is a view in section similar to that of FIG. 3, illustrating an alternative form of embodiment.

FIG. 5 illustrates another form of embodiment in which the notched face (36) of the bow faces toward the inside of the binding. The screw (38) has its end (31) which enters a screw thread formed in a moving part (35) capable of sliding in an opening formed for this purpose in the wall (32) of the side (4) of the baseplate. This moving part (35) has its face facing toward the outside of the binding (46), which is also notched, in the same way as the face (36) of the bow.

When the screw (38) is screwed in, the moving part (35) moves closer to the outside of the binding and presses the end (15) of the bow against the wall (11) of the side (4) of the baseplate. The end of the bow is thus held in position.

According to another feature of the invention, the opening (17) formed in the end (15) of the bow is elongate, so as to allow the bow to adopt a number of longitudinal positions.

Thus, when the bow (3) is translated forward or backward, the various notches allowing the heightwise adjustment slide one inside the other to allow the longitudinal position of the bow to be adjusted.

It then follows that the position of the bow can be adjusted to suit various boot sizes. The geometry of the opening made inside the bow can vary widely, according to the desired latitude for longitudinal adjustment, and depending on the optimum mechanical strength.

In practice, in the form illustrated, the longitudinal adjustment of the position of the bow (3) can vary by a few centimeters.

It is evident from the foregoing that the snowboard binding according to the invention has numerous advantages:

the possibility of adjusting the "canting" of the highback without acting on the mechanical connection between the actual highback and the bow;

precise fine adjustment of this "canting";

the possibility of adjusting the position of the bow longitudinally to suit different boot sizes;

the fact that the bow can be held in position relative to the baseplate using a single screw on each side.

What is claimed is:

1. A board binding comprising:

a baseplate for mounting on a snowboard;

a rear bow mounted on the baseplate at two attachment points;

a highback mounted to said rear bow to allow said highback to pivot with respect to the rear bow; and means for independently modifying a first point of attachment of the two attachment points of the bow to the baseplate from a first vertical position to a second vertical position, wherein said first vertical position and said second vertical position are substantially aligned in a vertical direction substantially perpendicular to a top surface of the snowboard.

2. The board binding as claimed in claim 1, wherein the means comprise:

two horizontally notched zones secured to the bow and to the baseplate, said notched zones having a number of relative positions;

anchoring means adapted to keep the two notched zones in a position corresponding to a desired vertical position of the bow with respect to the baseplate.

3. The board binding as claimed in claim 2, wherein a side of the baseplate comprises a moving part, said moving part comprising one of the notched zones, a second notched zone of the notched zones being on a face of an end of the bow adapted to face said moving part.

4. The board binding as claimed in claim 3, wherein the movement of the moving part is subject to the rotation of a locking screw passing through an opening drilled in the end of the bow.

5. The board binding as claimed in claim 4, wherein the moving part is located, relative to the bow, on the same side as a head of the locking screw.

6. The board binding of claim 5 wherein the head of the locking screw is located on the outside of the side of the base.

7. The board binding as claimed in claim 4, wherein the moving part is located, relative to the bow, on the opposite side from the head of the locking screw.

8. The board binding of claim 7 wherein the head of the locking screw is located on the outside of the side of the base.

9. The board binding of claim 4 wherein the opening is horizontally elongate.

10. The board binding as claimed in claim 1, wherein the baseplate has, on each side, a slot separating two walls between which an end of the bow penetrates.

11. The board binding of claim 1 further comprising means for adjusting the horizontal position of the points of attachment of the bow to the baseplate.

12. A board binding comprising:

a baseplate for mounting on a snowboard;

a rear bow mounted on the baseplate at two attachment points;

a highback mounted to said rear bow to allow said highback to pivot with respect to the rear bow; and means for independently modifying a first point of attachment of the two attachment points of the bow to the baseplate from a first vertical position to a second vertical position and wherein said two attachment points remain substantially aligned with each other in a vertical plane substantially transverse to the snowboard, when said first point is modified from said first vertical position to said second vertical position.

* * * * *